United States Patent [19]

Sheridan

[11] 4,443,011

[45] Apr. 17, 1984

[54] METHOD OF PLAYING CHESS FOOTBALL

[76] Inventor: Raymond J. Sheridan, 119 St. Marks Pl., Roslyn Heights, N.Y. 11577

[21] Appl. No.: 519,899

[22] Filed: Aug. 4, 1983

Related U.S. Application Data

[62] Division of Ser. No. 290,060, Aug. 4, 1981, abandoned.

[51] Int. Cl.[3] ..... A63F 3/00

[52] U.S. Cl. ..... 273/247

[58] Field of Search ..... 273/247, 255, 244

[56] References Cited

U.S. PATENT DOCUMENTS

| | | | |
|---|---|---|---|
| 543,291 | 7/1895 | Jessup | 273/247 |
| 543,463 | 7/1895 | Brown, Jr. | 273/247 |
| 671,855 | 4/1901 | Cummins | 273/255 |
| 787,792 | 4/1905 | Riley | 273/247 |
| 1,349,615 | 8/1920 | Koelthoffer | 273/244 X |
| 3,833,220 | 9/1974 | Schuadell | 273/247 |
| 4,211,410 | 7/1980 | Smith | 273/247 |

FOREIGN PATENT DOCUMENTS

| | | | |
|---|---|---|---|
| 2102527 | 4/1972 | France | 273/247 |
| 1578761 | 11/1981 | United Kingdom | 273/247 |

OTHER PUBLICATIONS

John Scarne, Scarne's Encyclopedia of Games, Chapter 24, "Dice", pp. 454–497, ©1973.

*Primary Examiner*—Richard C. Pinkham
*Assistant Examiner*—Scott L. Brown

[57] ABSTRACT

This invention relates to a game which can be played by two opposing parties utilizing a rectangularly shaped game board laid out to resemble the characteristics of a football field and marked off in evenly measured squares such that specific positions on the game board are specificallydefined, each player having the utilization of eleven (11) separate and distinct player pieces each having their own specific functional characteristics equatable to the eleven positions utilized by a football team, each opposing party having its opportunity to play offense as well as defense similar to that which exists during a football game, the movements of the respective player pieces being pursuant to and related to the rolling of dice. The players in turn roll a first die and move their pieces accordingly. The next turn each player rolls two dice, the next turn three dice and finally each player rolls four dice per turn until the current player is finished. The game incorporating all of the various aspects of the game of football, the overall object of the game being to score points as applicable to the game of football but in accordance with the rules and characteristics of the game.

1 Claim, 7 Drawing Figures

METHOD OF PLAYING CHESS FOOTBALL

BACKGROUND AND OBJECTS OF THE INVENTION

The present invention relates generally to a game of strategy utilizing movement across a rectangular game board marked off in evenly measured squares so as to define specific locations thereon wherein two opposing parties are able to recreate the characteristics and strategy associated with the game of football but within the characteristics and framework of a game capable of being played upon a game board.

In conjunction with the above, it is an object of this invention to create a new and unique game of strategy wherein the characteristics, strategy and flexibility of play associated with the game of football are recreated within the framework of a game of strategy capable of being played upon a game board.

It is another object of this invention to provide a game of strategy wherein opposing players seek to move across a game board pursuant to prescribed methods characteristic of the game of football with the object to traverse the game board so as to score against one's opponent.

It is another object of this invention to provide a game of strategy played upon a game board that is characteristic of a football field, wherein the playing of said game incorporates all of the features and various aspects associated with the game of football.

The object and advantages of the invention are set forth in part herein and in part will be obvious herefrom, or may be learned by practice of the invention, the same being realized and attained by means of the instrumentalities and combinations pointed out in the appended claims.

SUMMARY OF THE INVENTION

Briefly described, the present invention relates to a game which can be played by two opposing parties utilizing a rectangularly shaped game board laid out to resemble the characteristics of a football field and marked off in evenly measured squares such that specific positions on said game board are specifically defined, each player having the utilization of eleven (11) separate and distinct player pieces each having their own specific functional characteristics equatable to the eleven positions utilized by a football team, each opposing party having its opportunity to play offense as well as defense similar to that which exists during a football game, the movements of the respective player pieces being pursuant to and related to the rolling of dice, said game incorporating all of the various aspects of the game of football, the overall object of said game being to score points as applicable to the game of football but in accordance with the rules and characteristics of said game.

As herein preferably embodied, each opposing party during the course of the playing of said game, is either in an offensive posture wherein he seeks to traverse the game board against his opponent so as to score by crossing the goal line of said opponent, or in the alternative, is in a defensive posture, and seeks to block the progressive movements of said opposing party towards his respective goal line and/or seeks to take away from said opposing party pursuant to the framework as hereinafter set forth and as applicable to the game of football the offensive posture of said opponent during said opponent's attempts to score as applicable hereto.

As stated above, each opposing party has eleven (11) player pieces, both for offense as well as defense, said eleven (11) player pieces during offense corresponding to those positions associated with the offensive team and said eleven (11) player pieces during defense corresponding to those positions associated with the defensive team.

In keeping with the invention, the method by which movement either in an offensive or defensive mode is achieved is by the utilization of the rolling of dice, the totalling of the numbers from each roll providing the determination as to the various degrees of movement applicable to each opposing party in regards to a particular play, the offensive team, as in football, needing to go a specific distance on each four (4) series of downs, whereupon, upon achieving said minimum traverse across said game board within said four (4) series of downs, said offensive team achieves the opportunity to have another four (4) series of downs to seek to repeat said minimum advance same continuing, as in the game of football, until either there occurs a score by the offensive team, or, a change over in the possession of the ball due to a failure to so advance said minimum distance, or as a result of a fumble, or interception by said defensive team with regard to said ball.

Additionally, it should be noted that every aspect of the game of football is applicable and incorporated in said game, to include the concept of an offensive team, a defensive team, tackling, throwing of a forward pass, throwing of a lateral, punting, the kicking of field goals, the incurring of penalties for infractions of play, the blocking of kicks, interception of forward passes, fumbles, the scoring by way of achieving a touchdown, field goal and extra point, or by way of a safety, all of said concepts resulting in there being achieved a realistic and exciting transforming of the game of football into a game utilizing a game board and played by two opposing parties.

The concept of chess is incorporated in this invention in that one must not only be conscious of the movement of one's player pieces in accordance with the invention and its strategies, but must also be considering upon movement of one's player pieces, the providing for the countering of moves and strategies of one's opponent.

In addition to the above, the invention is able to incorporate and otherwise transpose into the play of said game the concept of a rapidly increasing tempo of movement encountered in a football game by utilization within said game, as applicable to the movement of player-pieces, the concept called, "progression", which is a term defining the manner by which players achieve movement of their respective player-pieces in accordance with the invention. More particularly, and in accordance with the invention, the term "progression" refers to the following method of movement of player pieces, to wit, the offensive player initially rolls one die and then moves each of his player pieces the number of spaces appearing upon said rolled die. The defensive player then rolls one die and moves each of his player pieces the amount of spaces appearing on said rolled die in response to said offensive player's moves. This procedure is repeated but each time one more die is added to the roll of each player until there has in fact occurred the roll of four dice for each player, rolling of four dice to continue for each player until said particular play is completed as hereinafter set forth, said sequence then completing what in effect is considered the first play of a sequence of four plays equatable to four downs in the game of football. As can be readily apparent from the above, there results a continuing shift in a player's strategy regarding each and every roll of the die and/or dice for each of said rolls as applicable to a particular down.

As previously stated, there is in fact achieved in the framework of the above, all of the strategy, movements, features and variations associated with the game of football but transformed onto a playing board in the context of a game.

It is in keeping with the above, and as hereinafter set forth, that the game of chess football is described, the accompanying drawings referred to herein and constituting a part hereof being illustrative of the invention but not restrictive thereof, and, together with the description, serve to explain the principals of the invention.

DESCRIPTION OF A PREFERRED EMBODIMENT

Figure 1:
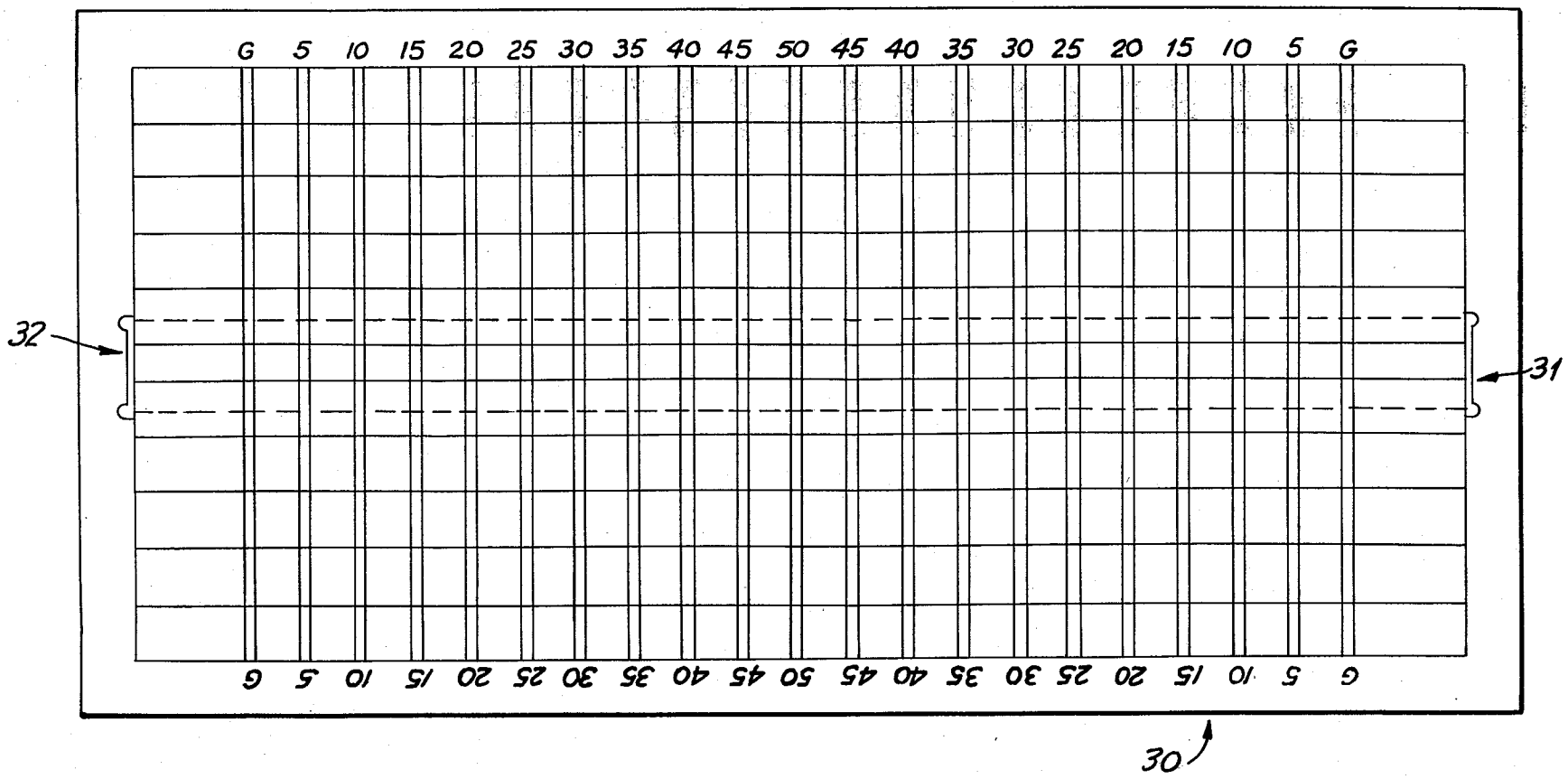
FIG. 1 is a lay out of the game board utilized in accordance with the invention.
Figure 5:
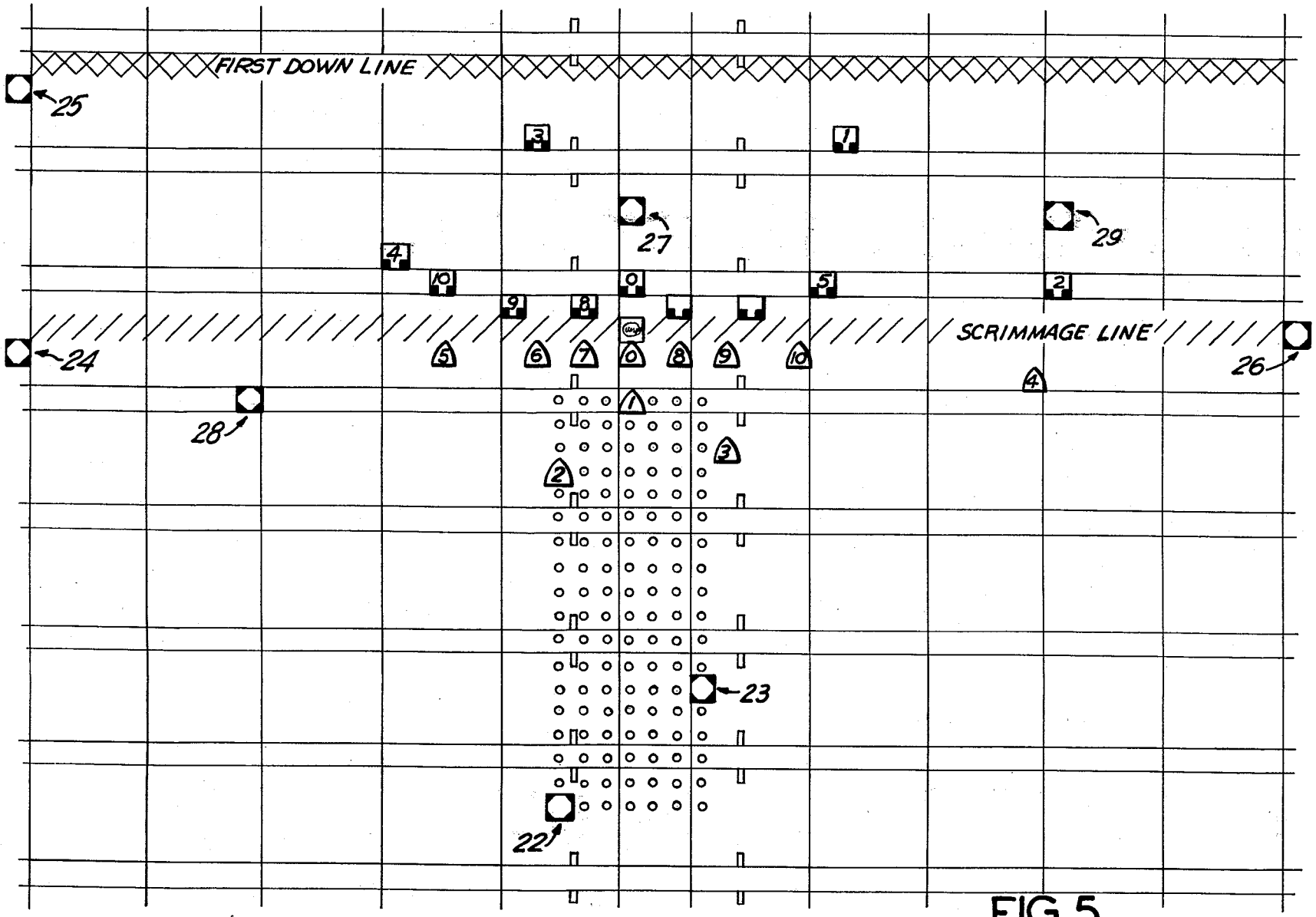
FIG. 5 depicts a typical alignment upon the playing board of both the offensive player pieces, the defensive player pieces, the various referees and judges along with the appropriate field markings associated with the commencement of a play in accordance with the invention.

Referring now more particularly to the embodiment of the above invention illustrated in the accompanying drawings and as hereinafter set forth, there is illustrated in FIGS. 1 and 5, the playing board 30 utilized in accordance with the invention, same providing a squared off rectangular playing surface having 53 squares across its width and 121 squares along its length, thereby providing 6,413 squares upon the playing surface of said board. As envisioned in the preferred embodiment, there is set forth from the side lines running lengthwise of said board in five square intervals line designations that are more readily recognizable than the regular lines appearing on said playing surface which define said 6,413 squares, said outstanding lines coming in from each side line resulting in therebeing left a three square width of squares running directly down the center of the playing board between goals.

In accordance with ten game board description set forth above, there is additionally set forth on the end zone lines, goal posts 31 and 32 at each end of said playing board 30, same being centered with a distance of 9 squares existing between the uprights of said goal posts.

Figure 2:
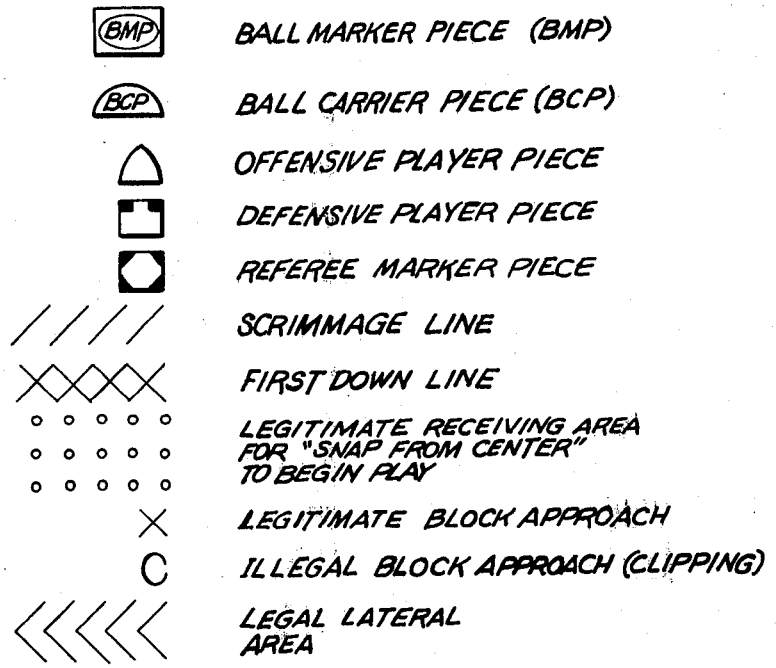
FIG. 2 sets forth the various legend designations appearing within the various figures of the drawings with the nomenclature associated therewith appearing immediately adjacent thereto.

Reference is herein made to FIG. 2 which sets forth the legend designations utilized in the various figures forming a part of this application, same being set forth as a means of understanding the various activities occurring on playing board 30. As shown in FIG. 2 there is illustrated the legend that will represent the ball-marker-piece (BMP), the ball-carrier-piece (BCP), the designation for an offensive-player-piece, the designation for a defensive-player-piece, as well as, the designation for a referee-marker-piece (RMP). Additionally, illustrated in FIG. 2 are the legends to designate and otherwise represent a "scrimmage line", a "first down line", the legitimate receiving area for a "snap from center" so as to commence play in accordance with the invention, the designation for a "legal lateral area", the designation for what represents the "legitimate block approach" for the blocking of a player piece, said designation being "X" and the designation for an "illegal block approach" (clipping) as related to the blocking of a player piece, said designation being "C".

Figure 3:
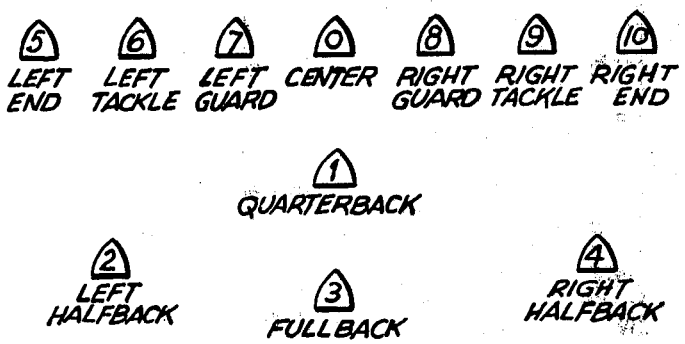
FIG. 3 sets forth the offensive player pieces with their appropriate numerical designations as utilized in the invention along with the appropriate terminology as applicable in the game of football, said offensive player pieces being positioned in a typical offensive alignment.

Reference is additionally herein made to FIG. 3 which represents the basic formation for the positioning of the offensive-player-pieces utilized in accordance with this invention, wherein the various player pieces as to their positions are given numbered designations "0" through "10".

Figure 4:
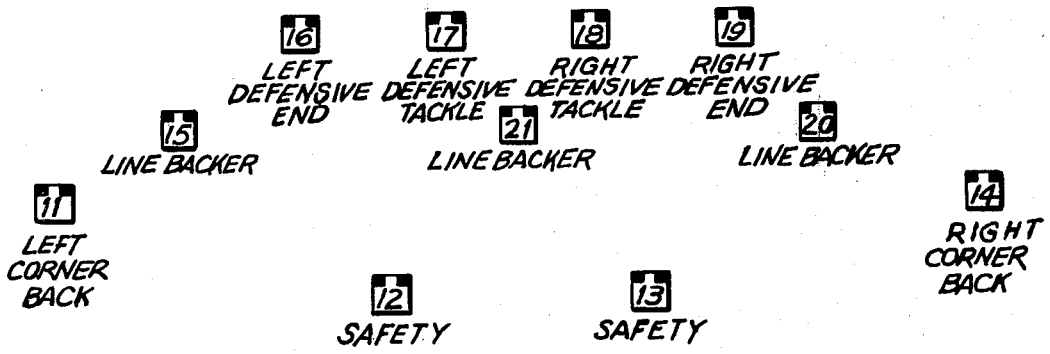
FIG. 4 sets forth the defensive player pieces with their appropriate numerical designations as utilized in the invention along with the appropriate terminology as applicable in the game of football, said defensive player pieces being positioned in a typical defensive alignment.

With regard to FIG. 4, there is represented the basic formation for the positioning of the defensive-player-pieces utilized in accordance with this invention, wherein the various player pieces as to their positions are given numbered designations "11" through "21".

Reference is herein made to FIG. 5 wherein there is depicted merely for the purposes of illustration an alignment of both the offensive team and defensive team with positioning of referee pieces as would be the case upon there occuring the initial snap from center as in the game of football, offensive-player-pieces "0" through "10" and defensive-player-pieces "11" through "21", being positioned as therein illustrated with referee pieces "22" through "29" being positioned as therein shown in accordance with said invention.

As with football, there are basically two teams, one opposing the other, therebeing 12 player pieces per team, the offensive-player-pieces being numbered as herein preferably embodied, "0" through "10" plus one ball carrier piece hereinafter designated as "BCP" and the defensive-player-pieces being numbered as herein preferably embodied "11" through "21" plus one ball carrier piece hereinafter designated as "BCP". The number appearing on each particular player piece denotes the player position represented by said player piece as illustrated in FIGS. 3 and 4, the ball carrier piece (BCP) marked or designated with "BCP" is interchanged on the playing board for any player piece that would be in possession of the ball at a given time during the course of play, and when same occurs, that piece represented by the ball carrier piece (BCP) is removed from the playing board at that time.

As with football, each team may only have eleven player pieces on the game board at any given time while the game is being played.

As herein preferably embodied, each player piece is constructed so as to have a square base which approximates the size of the particular squares marked off on the playing board, same being placed on the game board in line with the appropriate squares while the game is being played, therebeing a front and back to said player pieces so that the front thereof is positioned or faced towards one's opponent's goal line at the beginning of each play and then turned to face direction of movement when play begins. Additionally, as in the game of football, all player pieces are capable of being moved in any desired direction, be that forward, backward, sideways or diagonal, each being done so in accordance with the rules and concepts as herein set forth, and based upon the rolling of die as herein set forth.

Aside from the player pieces referred to above, there additionally is utilized in accordance with this invention and operation of said game, a ball-marker-piece hereinafter referred to as "BMP", a ball-in-air marker hereinafter referred to as "BIA", a block-marker hereinafter referred to by the letter "B", and a taking-out the interference marker, hereinafter referred to by the letter "T". With regard to the "B" and "T" markers, it should be noted that same are nothing more than markers, and other player pieces are capable of being moved through squares occupied by these markers during the course of play.

In accordance with the above, the "BMP" marker represents the location where the playing ball is at rest on the ground, this piece being used to denote said ball location prior to the beginning of each play or before a place kick or punt or if and when a fumble occurs. With regard to the "BIA" marker, this marker represents the position of the ball on a pass or kick before it has been caught by a player piece. With regard to the "B" marker these markers are envisioned in this particular embodiment as flat green squares having placed thereon the letter "B", and are placed on the playing board where a block has occurred during the course of play as hereinafter defined and set forth. With regard to the "T" markers, these also are flat green squares marked however with the letter "T" designation and are placed on the playing board to mark the square location where an offensive player piece has been taken out of play as a result of a defensive player piece functioning in accordance with the concepts as hereinafter set forth and in accordance with the concepts of the game of football.

In addition to the above mentioned markers, the game utilizes six dice, these being used to determine the moves of player pieces, measure distance and direction of kicks and for various other situations which will occur during the course of playing the game as hereinafter set forth, said dice being rolled and the resulting numbers on said dice adding to give a point total that in fact determines the degree of movement permissable on any particular roll.

In addition to the above, there is additionally utilized in accordance with this invention, referee-marker-pieces "22"–"29" hereinafter referred to as "RMP", therebeing eight of said marker pieces placed upon and utilized on said playing board during the operation of said game, same to represent the placement and location of referees as are utilized in the actual playing of the game of football, it being noted that other player pieces are not able to move to the squares occupied by the "RMP's" on the playing board during a particular play, however, but must move around said "RMP" location on said board. As is the case with regard to the playing of the game of football, the "RMP" pieces are placed on the playing board before each scrimmage play, and their location and function are as hereinafter described and as illustrated in FIG. 5.

In accordance with the above, referee number 22 is placed exactly twenty squares behind the line of scrimmage and three squares to the left of the "BMP" which is on the scrimmage line, facing the scrimmage line, at the beginning of each and every scrimmage play. Referee number 23 is placed exactly fifteen squares behind the line of scrimmage and three squares to the right of the "BMP" which is on the line of scrimmage and facing said line of scrimmmage. Referee number 24 is placed outside the side lines on the line of scrimmage, this referee piece being moved from play to play to denote the line of scrimmage as well as the down designation, referee number 24 being positioned so as to face the "BMP" and the opposite side line at the beginning of each and every scrimmage play. Referee number 25 is placed outside the side line, exactly ten squares forward from the line of scrimmage on a "first down" on the same side line as referee number 24 is placed. As is the case with the game of football, a first down is achieved if the offensive team advances the line of scrimmage one square beyond this referee marker in four scrimmage plays or less. Referee number 26 is placed outside the side line on the line of scrimmage on the opposite side of the playing board from referee number 24 as previously described, referee number 26 on said opposite side line facing the "BMP". Referee number 27 is placed exactly five squares forward from the line of scrimmage and directly in line with the "BMP" on the scrimmage line and facing the scrimmage line. Referee number 28 is placed exactly three squares behind the line of scrimmage and exactly ten squares in from the side line on the same side of the playing board as referee number 24 and facing the opposite side line. Finally, referee number 29 is placed exactly five squares forward from the line of scrimmage and exactly ten squares in from the side line on the opposite side of the playing board from referee number 27, referee number 29 also facing the line of scrimmage.

It should be noted that with the exception of referee number 25, which remains in position until a first down is achieved, or the possession of the ball changes, the location of the "BMP" after each down of play becomes the focusing point for the repositioning of all of the other referee designations from 22 through 29 as set forth above before the beginning of the following scrimmage play. Additionally, referees numbered 24 and 26 denote the line of scrimmage and are used to determine offside penalties while, as set forth above, referee 25 is used to determine when a first down is achieved, referees numbered 27 and 29 being used to determine the violations of illegal receiver or blocker downfield. Referees numbered 22, 23 and 28 are used to determine the legitimate receiving area for a player piece receiving the "snap from center" to begin a scrimmage play as illustrated in FIG. 5.

In accordance with the invention, there is incorporated and otherwise transposed into the play of said game, the concept of a rapidly increasing tempo of movement encountered in a football game by utilization within said game, as applicable to the movement of player pieces, a concept of what is herein stated as "progression" which is a term defining the manner by which players achieve movement of their respective player pieces in accordance with this invention. More particularly, and in accordance with this invention, the term "progression" refers to the following method of movement of player pieces, to wit, the offensive player initially rolls one die and them moves each of his player pieces in sequence, from player piece "0" through player piece "10", the number of spaces appearing on said rolled die, said player having the ability to move each and every one of his player pieces the number of squares appearing upon the face of said rolled die or any multiple thereof. Thereafter, the defensive player then rolls one die and moves each and every one of his player pieces in sequence, from player piece "11" through player piece "21", the amount of spaces appearing on said rolled die or any multiple thereof in response to said offensive player's moves. This procedure is repeated by each player, one more die being added to each of said rolls of said players until there has in fact occurred the roll of four dice by each player, rolling of four dice to continue for each player until said particular play is completed as hereinafter set forth. As can readily be apparent from the above, there results a continuing shift in the player's strategy regarding each and every roll of the die and/or dice for each of said rolls as applicable to a particular down.

In keeping with the invention and the overall concept of said game, it is the object during said game for the offensive team to advance the "BCP" as far forward or over the opponent's goal line to score a touchdown, or in the alternative, to score by kicking a field goal as applicable in the game of football, or should an individual be unable to score as a result of a particular sequence of plays, to achieve the best field position so as to prevent his opponent from scoring. Additionally, the defensive team seeks to prevent his opponent from advancing the ball towards his goal line and to prevent the offensive team from scoring either by way of a touchdown or a field goal, and to additionally seek to take possession of the ball away from his opponent in a manner and fashion as herein described and as contained within the concepts of the game of football.

In keeping with the above, the various aspects applicable to the game of football, to wit, the concept of tackling, blocking, a hand off, forward passing, completing a forward pass, failing to complete a forward pass, lateral, punting of the football, kicking a field goal, blocking a kick, kicking off, fumbling, scoring, as well as the incurring of penalties, are concepts applicable to this invention as hereinabove set forth and hereinafter explained in detail in accordance with the preferred embodiment of the present invention.

With regard to the concept of tackling as implemented in the present invention, same is achieved in conjunction with the "BCP" when a defensive player piece is moved upon the square occupied by the "BCP". Upon achieving the tackling of the "BCP" by a defensive player piece, said square designation then becomes the new line of scrimmage for the next play. As a means of keeping track of the ball location, and in keeping with the invention herein, the "BMP" is placed on said square designation until the next play begins. If the tackle occurs between the side line and the hash mark, the "BMP" is placed for the next play one square inside the nearest hash mark, on the same scrimmage line, as where the tackle occurred.

Figure 6:
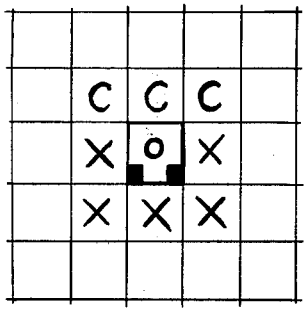
FIG. 6 depicts the permissible directions upon the game board whereby a player piece can be blocked without there resulting the penalty of clipping, said directions being designated by the letter "X", while those directions designated by the letter "C", would result, upon there occurring a block from those directions, a clipping penalty upon the offending player.
Figure 7:
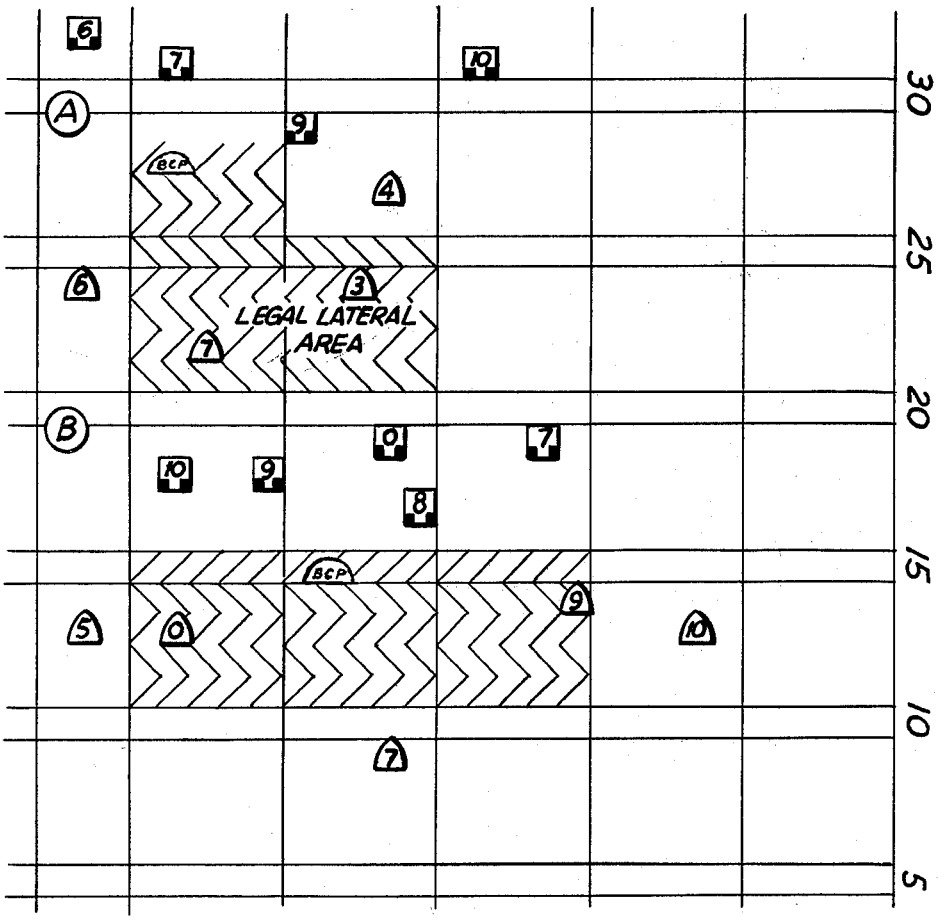
FIG. 7 represents one of the two permissible lateral situations applicable to the invention.

With regard to the concept of blocking, an offensive player piece upon being moved into a square occupied by a defensive player piece achieves the blocking of said defensive player piece. The block to be a block must be made from a frontal approach as set forth in FIG. 6, that is from a square designated by "X". If a player piece is blocked from a "C" approach as diagrammed in FIG. 6, clipping occurs which becomes then the basis for the offensive team incurring a penalty as hereinafter set forth. Upon there occurring a block, both the offensive player piece and the defensive player piece are removed from the playing board and are out of play during the particular play in question and remain so removed from the board until the next down occurs or as hereinafter set forth. Additionally, a "B" marker is placed on the square where said block occurred.

In keeping with the invention, and as part of the rules of play, only two defending player pieces can be blocked on the first roll of the "progression" sequence and only four defending player pieces can be blocked on a given play of an entire progression series. Violation of either of the two above referenced rules is considered "holding" and becomes the subject matter of the offensive team incurring a penalty as hereinafter set forth.

In addition to the above with regard to the concept of blocking, there is further imposed as part of the criteria for blocking the fact that a defending player piece cannot be blocked further downfield from the line of scrimmage than five squares on a given pass play until a determination of the results of the pass is made as hereinafter described. Violation of this rule constitutes the incurring of a penalty known as "offensive interference" as hereinafter set forth.

Additionally incorporated into the concept of blocking, is the concept applicable to the game of football and incorporated herein and referred to as "taking out the interference", same being when a defensive player is moved into or through a square occupied by an offensive player piece during the occasions when the defensive team has its turn to move its player pieces. In this case, the offensive player piece is removed from the playing board and is out of play until the next play occurs or as hereinafter described. Under these circumstances, a "T" marker is placed on the square and the defensive player piece remains in play and may continue with any moves left, if same be the case, with regard to the "progression" sequence. Additionally, in accordance with the concept of "taking out the interference" only three offensive player pieces may be removed from play in this manner on any given play or "progression series", a violation thereof constituting the incurring of a penalty known as a "personal foul" as hereinafter set forth and described. Additionally, the offensive-backs and ends as associated with the player positions of the offensive team associated with the game of football cannot be taken out in this manner if they have been moved across the line of scrimmage or until the "BCP" has moved to the line of scrimmage or beyond. A violation of this rule is considered "defensive-pass interference", subjecting the defensive team to the incurring of a penalty as hereinafter set forth.

Upon the completion of a down by an offensive team as herein set forth and thus the completion of the "progression series" associated therewith, all "B" and "T" markers are removed and all player pieces, be they offensive or defensive pieces, are placed back upon the playing board at their respective locations in preparation for the next play. After interception, fumble or after the ball has been kicked in the kicking sequence, all of the above being in accordance with the invention as herein described, as hereinabove set forth, the player pieces that have been either "blocked" by an offensive player piece or "taken out" by a defensive player piece as described above, are returned to play, defensive player pieces being returned to the playing board where the "B" markers are located, facing the opponent's goal line and offensive player pieces are returned to the playing board immediately in front of the returned defensive player pieces, facing the opponent's goal line. Additionally, offensive players are returned to the playing board where the "T" markers are located, said player pieces facing the opponent's goal line, the "B" markers and the "T" markers thus being removed from the playing board. Upon accomplishing the above, play continues as herein described in accordance with a new "progression series", wherein blocking, tackling and the taking out of the interference beginning all over again in accordance with the above concept.

With regard to the implementing of the concept of a hand off, as incorporated in the game of football, and as implemented in the instant invention, a "BCP" may hand off the ball to another player piece by sacrificing two of its "progression" moves and must be in a square adjacent to the player piece receiving the hand off at the time the hand off occurs. Upon failing to follow the above, a "fumble" occurs as defined hereinafter. On a scrimmage play, only offensive backs or ends are eligible to receive a hand off and failure to follow same results in the incurring of a penalty termed "illegal procedure" as hereinafter defined, however, hand offs can occur in open field running situations not limited to offensive backs or ends, but only one such hand off is allowed under such an open field situation per progression series. Upon there occurring a hand off, the "BCP" must continually be interchanged on the playing board with the player piece to whom said hand off occurred so as to be able to provide a means consistent with the playing of said game for noting where the position of the ball can be located.

A player piece may continue its progression moves after the hand off of said ball in accordance with the above if there are moves left according to the amount designated upon that particular roll of the dice or die. Upon there occurring a hand off to another player piece, even though the "BCP" is interchanged for said piece, both player pieces will move in their numerical sequence until "progression" is completed, same resulting in either therebeing additional movement of said player pieces upon said board depending upon the numerical count resulting from the roll of said dice or die or, same remain on the respective squares of the game board upon there not being further ability to move due to the complete utilization of the particular numerical designation resulting from said roll of dice or die.

As is the case in the game of football, there is also implemented in the instant invention the ability for an offensive team to utilize the concept of a "forward pass" as a means to advance the ball towards the opponent's goal line. In accordance with the invention, a "BCP" may throw a forward pass as long as there is sacrificed two of the progression moves associated with a particular roll of dice or die as long as the "BCP" is behind his side of the line of scrimmage. Additionally, pursuant to the invention herein, a forward pass may only be thrown on a scrimmage play and only one forward pass can be thrown on a particular given scrimmage play, a forward pass being one that must progress the ball forward from the point that it is thrown on any roll of the "progression series", however, in order to determine whether or not said forward pass is completed, the defensive team must have completed its moves through the same roll of said progression series as that of the offensive team. When a pass is thrown the "BIA" must immediately be placed on the square where the ball is thrown and the player who is throwing the pass may select any square that is within seventy squares of his "BCP" at the time said pass is thrown. The "BIA" cannot be placed any closer than three squares to an offensive player piece. If it is placed any closer, that particular offensive piece is not eligible to catch said pass. Additionally, the "BCP" is removed and replaced by its represented player piece while the "BIA" remains in position until a determination of the pass result is made.

Additionally, both the offensive team and the defensive team complete all of their moves associated with the roll of that particular progression roll, it being kept in mind that only offensive ends or backs are eligible to catch a pass as well as the fact that any defensive player piece is also eligible to intercept said forward pass by catching it.

Keeping with the invention, in order for a player piece to be eligible to catch a forward pass, the following moves for eligibility must be completed on the same roll of said progression series as when the passes are thrown, to wit, said player piece must be moved through the square occupied by the "BIA" and at least two squares beyond while still remaining within bounds of the playing field; a player piece that is moved through the "BIA" must continue all of its moves of said progression series in the same direction it has approached the "BIA" even if this would carry the player piece off the playing board or into or through a square occupied by an opposing player piece; only one offensive player piece may attempt to catch the particular pass in question, and if more than one offensive player piece moves through said "BIA", the pass is incomplete as far as the offensive team is concerned; and additionally, any number of defensive player pieces may attempt to intercept the pass as long as they meet the previously described criteria.

To be eligible for receiving a forward pass a player piece that has met the above referenced criteria regardless of whether or not said player piece is a defensive player piece or an offensive player piece is a player piece that has moved the most number of squares beyond the "BIA", and as such, qualifies to be the first player piece to be considered for possibly being considered to have received said forward pass, said player piece who has moved the most number of squares beyond said "BIA" then being given the opportunity to roll dice in accordance with what is termed a "catch roll" as hereinafter described. If the ball is caught by the intended receiver, the "BCP" is interchanged on the playing board and the play continues. If the ball is caught, but the player piece designated goes out of bounds after having caught same at the end of the progression sequence associated therewith, and said pass is considered complete in accordance with the above prescribed rules, the new line of scrimmage for the next play is where said player went out of bounds. If the pass is not caught by the first eligible receiver, and there are other eligible receivers as described above, they may now attempt to catch said pass in accordance with the above stated cirteria said eligible receivers being taken in sequence according to how may squares beyond the "BIA" they have moved.

As is the case with the game of football, it is possible that a thrown forward pass can go incomplete, and an incompleted pass occurs when the "catch roll" criteria is not met as hereinafter described resulting in the next play or down continuing from the original line of scrimmage. In the eventuality that no player piece qualifies for a "catch roll" then said pass is determined to be incomplete and the next play or down would also continue from the original line of scrimmage. In the eventuality that a defensive player piece qualifies as the first eligible receiver to attempt to catch the pass, said defensive player has the option of either blocking the pass so as to have said pass be considered incomplete, resulting in the next play or down continuing from the original line of scrimmage, or in the alternative, said defensive player may follow the "catch roll" procedure to attempt to intercept said pass, and upon failure thereof, the next eligible player pursuant to the above criteria will attempt to qualify for catching the pass in accordance with the "catch roll" criteria. If a defensive player intercepts a forward pass, the possession of the ball changes over to the then defensive team which then becomes the offensive team and the game proceeds, all of the player pieces heretofore removed being returned to the board and the progression series begins in accordance with the invention. In accordance therewith, a new progression series starts, the "BCP" being interchanged and the "BIA" being removed.

In accordance with the invention, the concept of utilizing the "catch roll" is incorporated as a means to determine whether or not a forward pass is completed, this occurring when a "BIA" is placed on the playing board during the game and when a player piece moves onto or through the square occupied by said "BIA". A "catch roll" consists of the rolling of two dice and combining the numerical sum thereof, it being designated that if said sum is either 6, 8, 10 or 12, said ball is not caught, and if any other total is achieved upon the roll of said pair of dice, the ball is considered caught and the "BCP" should be interchanged on the playing board and play continues in accordance with the invention as herein described. It should be noted that the "catch roll" utilizing the rolling of two dice is a completely separate roll of dice to determine whether or not a ball is caught and in no way should be confused with the rolling of dice in accordance with a "progression series".

As is the case in football, there can occur pass interference either of a defensive nature or of an offensive nature, such an occurrence resulting in the incurring of a penalty as hereinafter set forth. In keeping with the invention, defensive pass interference occurs when a defensive player piece either tackles, blocks or otherwise takes out an offensive player piece that is playing the position of that of an offensive back or an offensive end, said offensive piece having crossed the line of scrimmage or beyond, before the "BCP" has moved to the line of scrimmage or beyond. Additionally, defensive pass interferences will also occur when a defensive player piece has moved through the "BIA" and into or through a square occupied by an offensive back or an offensive end. The final set of circumstances under which defensive pass interference can occur is when an opposing player piece is blocked by a defensive player piece before a determination of an interception is made.

Offensive pass interference occurs when an offensive player piece blocks a defensive player piece further downfield than five squares from the line of scrimmage on a pass play, before a determination of the pass result is made. Additionally, offensive pass interference occurs when an offensive player piece moves through the "BIA" and into or through a square occupied by a defensive player piece or when an offensive player piece tackles an opposing player piece before a determination of an interception is made.

In accordance with the above, it should be noted that when a pass is thrown, a defensive player may elect to move one of his player pieces directly to tackle an eligible receiver without moving through the "BIA" in an attempt to intercept the pass. Furthermore, a pass may still be caught by said eligible receiver, even though he has been tackled, as long as the previously described criteria for reception have been met. Obviously, if the pass is caught, the new line of scrimmage is where the tackle was made and if the pass is incomplete, the line of scrimmage for the next play is the original line of scrimmage. Although the above sequence of events may occur upon the throwing of a pass, a defensive player is not precluded from seeking to tackle and eligible receiver in accordance with the criteria hereinabove set forth with one of his defensive player pieces while utilizing another defensive player piece in attempting to intercept the pass in accordance with the criteria hereinabove set forth.

As is the case in the game of football, there is the ability for a player to utilize the play option of a lateral, same being achieved as long as the following conditions are met; to wit, the player initially states that he is going to utilize the play option of a lateral prior to the particular play occurring and designates the player piece to whom the lateral is to be thrown, the "BCP" sacrifices three of its progression moves to throw the lateral, the lateral must always be to the side or behind the "BCP" and the player piece designated to receive the lateral must be within a five square area immediately adjacent to the "BCP", there cannot be an opposing player piece within the five square area where the lateral is thrown, the lateral cannot be made across the three square width of the direct center of the playing board to have the lateral completed, a "catch roll" must be made by the player who is lateralling the ball and the "catch roll" criteria met to achieve completion.

Reference is made to FIGS. *7a* and *7b* wherein there is illustrated two examples of the areas defined by the above criteria wherein offensive player "BCP" is capable of accomplishing the lateral of the ball in accordance with the invention. If the lateral is caught in accordance with the above criteria, play continues and if it is not caught, then a fumble occurs as herein defined and set forth and the defined fumble consequences therein bein applicable, the position of the ball after a fumble being measured from the "BCP".

In keeping with the invention, there is also the ability to incorporate the concept of a fumble in the present invention, a fumble occurring under the following circumstances, to wit, whenever a player piece receives a snap from center which is outside the designated area for receiving same as hereinafter set forth, when a double 2 or a double 4 are rolled by an offensive player on the second roll of his "progression series"; whenever in a lateral sequence, the lateral criteria is not followed, or, upon any kicking situation when a "catch roll" is utilized and a party fails to catch the ball on and in accordance with said "catch roll" criteria. Under such circumstances, a fumble occurs resulting in, as is the case in football, the ability of either team to recover possession of said ball.

Upon there occurring any of the above circumstances indicating that a fumble has in fact occurred, all player pieces are returned to the playing board, be they either blocked by an offensive player or "taken out" by a defensive player in accordance with the invention. To determine the location on the playing board where the fumbled ball has come to rest as a result of said fumble, the player who is charged with having fumbled the ball, rolls two dice, the numerical sum thereof determining the placement of the ball, the point of reference from which same occurs being the location on the playing board at which point said fumble occurred, said criteria of placement being as follows: upon rolling the sum of 2, the ball is placed two squares diagonally to the left from the point of said fumble using the direction of play said fumbled player was facing prior to said fumble; upon rolling the sum of 3, the ball is placed three squares diagonally to the right from the point of said fumble using the direction of play said fumbled player was facing prior to said fumble; upon rolling the sum of 4, the ball is placed four squares directly lateral to the left from the point of said fumble using the direction of play said fumbled player was facing prior to said fumble; upon rolling the sum of 5, the ball is placed five squares directly lateral to the right from the point of said fumble using the direction of play said fumbled player was facing prior to said fumble; upon rolling the sum of 6, the ball is placed six squares backward diagonally to the left from the point of said fumble using the direction of play said fumbled player was facing prior to said fumble; upon rolling the sum of 7, the ball is placed seven squares backward diagonally to the right from the point of said fumble using the direction of play said fumbled player was facing prior to said fumble; upon rolling the sum of 8, the ball is placed eight squares directly backward from the point of said fumble using the direction of play said fumbled player was facing prior to said fumble; upon rolling the sum of 9, the ball is placed nine squares directly forward from the point of said fumble using the direction of play said fumbled player was facing prior to said fumble; upon rolling the sum of 10, the ball is placed ten squares directly backward from the point of said fumble using the direction of play said fumbled player was facing prior to said fumble; upon rolling the sum of 11, the ball is placed eleven squares forward diagonally to the right from the point of said fumble using the direction of play said fumbled player was facing prior to said fumble; upon rolling the sum of 12, the ball is placed twelve squares backward diagonally to the left from the point of said fumble using the direction of play said fumbled player was facing prior to said fumble.

Once the ball has now been located as having come to rest at the particular point on the playing board following the above criteria, each player then rolls one die and the highest number rolled by one of the two players gives that particular player the opportunity of proceeding first with a "progression series", the object being for each player to have one of its player pieces either get to or go through the location on the playing board where the ball was placed to rest in accordance with the above referenced fumble criteria.

Upon there occurring one of the parties having one of its pieces either come to rest or go through the location on the playing board where the fumble has come to rest, said player then rolls one die and if it is odd in number, that player has failed to recover the fumble and the play continues until one of the parties has in fact recovered said fumble. If in fact said roll of die results in an even number, then that particular player has in fact recovered the fumble and play continues following the "progression series" criteria until there has in fact occurred the tackling of said ball carrier piece in accordance with the invention as herein set forth or a touchdown.

Upon there occurring a fumble that results with the ball going out of bounds, last player piece who retained possession of the ball is considered still in possession of the ball for the next down at the place where the ball went out of bounds except on fourth down whereupon the opposing team would take possession at said point of going out of bounds.

As is the case with the game of football, there is the ability to kick the football in the same manner as a ball is kicked in the actual game of football. In accordance with the invention the distance of all kicks will always be four times the sum achieved upon rolling of three dice except as hereinafter defined as applicable to an on-side kick. With the exceptions of kick offs and free kicks, all kicks will take place on the third roll of the offensive teams progression series. The player who is kicking the ball must verbally state to his opponent that he is in fact kicking, prior to rolling the dice for the third roll of said progression roll and upon failure thereof, he is prevented from in fact kicking on that particular play. The direction of all kicks will be determined by the player who is doing the kicking and in accordance with the following kick direction criteria, said kick direction procedure to proceed each of said kicking situations.

In conjunction with the invention, the direction by which the kick of the ball shall occur shall be as follows, to wit, initially the kicking player selects one of the following markers upon the playing board, to wit, the left hash mark, the right hash mark, or the middle square of said playing board, said selection to represent said player's desired direction by which said kick should occur. The next step in determining said direction of kick, is to have the kicking player roll one die, an odd number representing the fact that the kick will go to the right of the direction of kick selected by the kicking player as referred to above, to wit, either the left hash mark, the right hash mark or the middle square of said playing board, whereas, should an even number be rolled, this will indicate the fact that the kick will go to the left of same. The next step once the above have been accomplished is to have the kicking player select any number of dice from one to six which he will then roll, the sum thereof representing the number of spaces either to the left or to the right of said designated location said kick is to follow. Once the above has occurred, three dice are then rolled and the kick distance as defined above is determined, to wit, four times the roll of said three dice, the location however being determined as referred to above.

To execute the kicking of a punt, the "BCP" that received the snap from center, must still be in possession of the ball at the time of the third roll of the progression series, the ball not having been previously handed off to other player pieces. The "BMP" is placed in the square immediately in front of the "BCP" on the snap from center, and remains there until the ball is actually kicked. The kicking player verbally states that he is in fact kicking a punt prior to the rolling of the third roll in the progression series and upon failure to so state, he waives his right to so kick during that particular play. When the ball is actually kicked, the kick direction is determined as referred to above in the kick direction procedure, the "BCP" is removed and interchanges, the "BMP" is removed and the "BIA" is placed on the playing board as determined by the roll of said three dice. The distance of all punts is measured from the line of scrimmage unless the "BCP" is further back behind the line of scrimmage then "RMP" number 23. Whereupon, should that situation occur, the distance is measured from the location of the "BCP". All player pieces that were blocked or taken out are returned to the gameboard as previously described.

Upon there occurring a kick which remains in bounds, the player receiving the kick rolls one die, to begin the new progression series. Under such circumstances the player receiving said kick may move four of his player pieces closest to his own goal line each an amount of said roll. His remaining seven player pieces may be moved fifteen squares each independent of the number rolled with regard to said one die. The player who kicked the ball shall be able to move eight of his player pieces each three times the amount of the original kicking roll while his remaining three player pieces may be moved fifteen squares each independent of the sum associated with said kick ball.

Upon completion of the above, the player receiving the kick now rolls two dice which represents his second roll in the new progression series and moves his player piece in numerical sequence in accordance with the normal procedure associated with rolls of progression series as hereinbefore set forth. Additionally, the player who kicked the ball then proceeds with his second roll of said new progression series and moves his pieces accordingly.

If no player pieces reached the "BIA" by completion of the second roll of the new progression series, the ball is considered dead at the "BIA" which then becomes a new line of scrimmage for the next series of downs, possession of the ball being with the player who received said kick.

If an offensive player pieces reaches the "BIA" before the completion of both parties' second roll of said new progression series, the ball is dead at the "BIA" and this becomes the new line of scrimmage for the next series of plays, the receiving team taking possession of the ball.

In the eventuality that the kick is carried out of bounds, the new line of scrimmage is where said ball went out of bounds and if the kick is carried into the opponents end zone and is not returned, the receiving team takes possession of said ball on its own twenty yard line.

In keeping with the invention, there is also the ability for the kicking of a field goal, the procedure to accomplish same being as follows. The "BCP" who will receive the snap from center must still be in possession of the ball as of the third roll in the progression series, said ball not being able to be handed off to another player piece. The "BMP" is placed in the square immediately in front of the "BCP" on the snap from center and remains there until the ball is kicked. Additionally, an offensive player piece must be in a square adjacent to the "BMP" on the snap from center and on the same line therewith, this player piece thereupon being turned to face the "BMP" on the snap from center and must remain in this position until the ball is kicked. As with the other kicking situations, the offensive player verbally states that he is kicking a field goal prior to the third roll of the dice in the progression series and upon his failure to so do, he forfeits his right to so kick. Upon the ball being kicked, the kick direction procedure previously set forth herein is carried out by the kicking player, the "BIA" is placed on the playing board and the distance of the kick on the field goal attempt is measured from the "BCP".

A successful field goal attempt is achieved upon having the ball as hereinabove kicked pass through the uprights of the goal posts positioned on the playing board as previously set forth, with the additional criteria that there be sufficient distance as to said kick as to carry the ball at least a distance of four squares beyond said goal post uprights. If the attempt is unsuccessful as to the kicking of a field goal, the opposing player takes possession of the ball on the original scrimmage line from where said attempted field goal occurred. If said location is within the twenty yard line of the opposing player, then said opposing player takes possession of said ball on his own twenty yard line.

As is the case with the game of football, the defending player may attempt to block a kick before it occurs, said procedure being as follows, to wit, said defending player must move one of his player pieces into or through the square occupied by the BMP prior to the ball being kicked and said player piece must continue all of its progression moves in the same direction that it was proceeding as it approached and passed through said BMP designation, even if this would carry said player piece into or through a square occupied by an opposing player piece. Upon a defender player piece moving through the BMP and its progression moves carry it into or through the square occupied by the BCP on a punt, there occurs the penalty of "roughing the kicker" as hereinafter set forth as regarding penalties. If a defending player piece moves through the BMP and its progression moves carry it into or through a square occupied by an opposing player piece other than the BCP, the kick is blocked but without the incurring of any penalty. On a blocked field goal attempt regardless of movement of the defending player pieces, no "roughing the kicker" penalty will occur.

Upon the blocking of a kick, same is treated as if a fumble occurred as hereinabove set forth as regarding fumbles.

If a kick is not made on the third roll of the offensive progression, for any reason, the offensive player must move his BCP into or through the square occupied by the BMP before continuing his progression moves. The BMP is then removed from the playing board at this time and upon failure of the offensive player to so do and the BCP is moved in any other way, the ball is considered to have been fumbled and the rules applicable to fumbles as hereinabove set forth become applicable.

As regarding a kick off, same is achieved by placing all eleven player pieces of the kicking team on the offensive player's thirty-five yard line facing the opponent's goal line. The team receiving the kick places five of its player pieces on his opponent's forty-five yard line, facing the opposing goal line while the remaining six player pieces are capable of being placed anywhere behind said five player pieces, said six player pieces so placed also facing the opponent's goal line. Upon such placement of said player pieces the kicking player states that his player pieces are "set" for the kick off and the receiving player then states that his player pieces are "set" for the kick off.

In conjunction with said kick off, the kick direction of said kick is determined as hereinabove set forth with regard to determining kick direction and the kicking player rolls three dice to determine the kicking distance. Additionally, the "BIA" is placed on the playing board at the point of the kick.

The defensive player receiving the kick then rolls one die, the defensive player who is receiving said kick being able to move the four of his player pieces closest to his goal line each an amount of said roll while his remaining seven player pieces may be moved fifteen squares each. Next, the player who kicked the ball is then able to move eight of his player pieces each three times the amount of the original sum achieved upon rolling said three dice to determine the distance of the kick, the remaining three player pieces of said kicking player being able to be moved a maximum of fifteen squares each.

Next, the receiving player rolls two dice said roll representing the second roll of progression and there upon moves all of his player pieces in numerical sequence as previously described as applicable to a progression roll. Thereafter, the kicking player rolls two dice and proceeds to move his player pieces in accordance with a progression roll as previously defined. It should be noted that a kick off as described above is basically a free ball which either the defensive team or offensive team can get possession of by having one of its player pieces reach the "BIA" location on said playing board, this being contrary to a punting situation wherein only the receiving team can obtain possession of the ball.

If no player piece reaches the "BIA" by completion of the second roll of progression as hereinabove described, the progression sequence continues until one player obtains possession of the ball.

If the kick off results in the ball being out of bounds, a five yard penalty is assessed against the kicking team and the ball must be kicked over again in accordance with the above criteria.

In the eventuality that a safety has been scored, which means, as is the case with the game of football, the tackling of an offensive ball carrier behind his goal line, a ball fumbled out of bounds behind said goal line, or a blocked kick out of bounds behind said goal line, the player upon whom there was scored a safety, has a free kick from his twenty yard line, the procedure for same being that as hereinabove set forth as regarding a kick off, the only difference being that the kick originates from the twenty yard line. Additionally, the player receiving said kick will place five of his player pieces on his opponents thirty yard line facing the opponent's goal line while his remaining six player pieces can be placed anywhere behind the location of said five player pieces.

As is the case with the game of football, an on-side kick is also applicable to the invention at hand, it being at the option of the offensive team at any kick off or free kick situation, the kicking player so designating same to be the case immediately prior to such a kick. In the situation of an on-side kick, the ball will travel only two times the sum of the rolling of three dice instead of four times said sum as previously described with regard to a regular kick off or a regular free kick situation.

Under the circumstances of an on-side kick, the ball once kicked is a free ball if it has carried at least 10 squares and any player piece moving through the "BIA" and executing a catch by and in accordance with the catch roll sequence hereinbefore described takes possession of the ball and play continues by having the player who obtains possession proceed with a full progression sequence.

As is the case with the game of football, the method by which a participant scores points is, in the first instance, achieving a touchdown against one's opponent, which occurs whenever the "BCP" is moved across one's opponent's goal line and into the end zone, or if a pass is caught in the opponent's end zone, or a fumble recovered in opponent's end zone the point at which the above occurs constitutes a scoring of a touchdown, regardless of whether or not the progression series is completed. As is the case with football, a touchdown is worth six points.

In addition to scoring by way of a touchdown, there is the ability for a participant to score points by the kicking of a field goal, which, as hereinbefore set forth, constitutes the kicking of a ball through one's opponent's goal posts and at least four squares beyond the positioning thereof, a field goal constituting three points.

Additionally, a participant is able to score an extra point after a touchdown has been scored, a player seeking to score an extra point after a touchdown as the ball positioned on said opponent's three yard line and the kicking process through one's opponent's goal posts and at least four squares beyond as hereinbefore set forth, constituting a successful kick resulting in the scoring of an additional point after touchdown.

The final means to score points is to score a safety, which occurs by tackling the "BCP" behind that player's goal line or by blocking a kick that goes out of bounds behind said goal line or by having one's opponent fumble said ball behind his goal line which then goes out of bounds behind said goal line, the resulting safety resulting in a two point score to the player who achieves a safety against his opponent, the ball then being placed on a twenty yard line of the player upon whom said safety was scored who then in turn has a free kick as hereinbefore defined.

It should further be noted that there is the ability to incorporate in the present invention the ability of an offensive player to be set in motion on a particular scrimmage play once the "set" position has been achieved, just as is the case in the actual game of football. To accomplish the above, the offensive player who wishes to utilize the "in motion" procedure does so once he has positioned his player pieces prior to the commencement of a play as well as after the defensive player has also set his defensive players on said playing board in response thereto. Once both the offensive and defensive players have thus been positioned, the offensive player then states "motion" before he rolls the die to begin a progression sequence. Under such circumstances, said offensive player may choose one, two or three dice to roll to move one of his player pieces "in motion" which means having such a player piece move laterally parallel to the scrimmage line towards either side line of the field. A player piece so moved cannot be any player piece that is on the scrimmage line as this would result in an illegal procedure penalty being incurred. Once the die or dice are rolled, the sum total thereof then determines the number of spaces on the game board the particular player piece in question can move parallel to said scrimmage line. After the offensive player piece has been so moved, the defensive player now rolls the same number of die or dice that the offensive player rolled and the defensive player may move any number of his player pieces a number of spaces that total the roll of his die or dice in an attempt to adjust the defensive positioning of players in response to the offensive repositioning of a player. It should be noted that the defense is not able to move each and every piece a number of spaces equal to said roll but rather, is limited to the number of spaces so rolled which can be apportioned among as many player pieces as is desired by the defensive player. Once the adjustments as referred to above, have in fact been made, the progression series continues with the offensive player commencing the first roll thereof.

With the above in mind reference is now made to a basic scrimmage play applicable to the invention herein, same occurring upon both the offensive and defensive teams having their respective player pieces placed at least one square behind the scrimmage line, failure to so do resulting in incurring of an off side penalty, it additionally being understood that the respective player pieces face their opponents goal line at the beginning of each play and failure to so do resulting in an illegal procedure penalty.

In accordance herewith, the offesnive center designated by the letter "O" must be in the square directly behind the "BMP" to begin the scrimmage play, and failure to be so positioned results in a fumble and the consequences as hereinbefore set forth the fumble being measured from the designated player piece who was to receive the snap from center. Additionally, the offensive team must have seven player pieces on the scrimmage line to begin a play and although more than seven can be so placed on said scrimmage line, there cannot be less than seven, and should that occur there results an illegal procedure penalty.

The offensive player pieces number "5" and "10" must be the furtherest out towards either side line of the linemen at the beginning of a scrimmage play otherwise there is occurred an illegal procedure penalty. On a pass play only the offensive ends or backs may proceed further downfield than five squares beyond the scrimmage line until a pass determination is made, otherwise there again occurs an illegal procedure penalty. On the kicking play, only the offensive ends can proceed further downfield than five squares beyond the scrimmage line until the ball is kicked, a violation thereof again resulting in the incurring of an illegal procedure penalty. Furthermore, in order to have a play being, the snap from the center to a player piece designated to receive same, must have said player piece located within the dotted area as set forth in FIG. 5. As is the case with the game of football, defensive player pieces may be deployed in any manner upon the playing board as long as they are not off side and as long as they are facing the opponent's goal line when play begins, see FIG. 5.

To begin a scrimmage play, the offensive player after he has placed all his player pieces in position will say "set" whereupon the defensive player also places his player pieces in position and then indicates "set".

The offensive player then rolls one die to begin progression whereupon he immediately designates which of his player pieces will receive the snap from center and will interchange his "BCP" for that player piece on the playing board. Once stated the designated player piece cannot be changed. Play then commences and no adjustments are made. If a player piece designated to receive the snap from center is not within the legitimate receiving area as set forth in FIG. 5 there occurs a fumble and its consequences as hereinbefore associated with fumbles results. Additionally, upon the roll of a die, the "BMP" is removed from the playing board and the offensive player proceeds to move his player pieces in accordance with the invention as hereinabove described, keeping in mind that this procedure is utilized with each and every play and the player pieces are moved in their numerical sequence starting with "0" and ending with "10". The "BCP" is moved in the numerical sequence of player piece numbers as with respect to the player piece said "BCP" replaces. In accordance herewith, a player has the option of forfeiting the moves of any of his player pieces or only using part of the progression moves available to a particular player piece, but must so state that fact as the numerical sequence of a particular player piece come up for movement.

In accordance with the instant invention, penalties as hereinbefore stated can occur as would be the case in the normal operation of play of a football game. In conjunction therewith, it is the responsibility of each player to call violations to the attention of his opponent at the point in time same occur as in the case of the game of football play will continue to completion in accordance with the invention and any penalty that is to be assessed will in fact be assessed after play is completed. In the event that a penalty is not noted at the time of occurrence then no penalty can be assessed at a later point in time. As is the case in the game of football, a player has the option of accepting or declining the penalty in most cases, as is the case in the game of football, and penalties are marked off from the original line of scrimmage.

In accordance with the invention, the following penalties and their appropriate assessment are herein set forth, to wit:

1. Illegal Procedure: Five (5) yards or loss of down
2. Offside: Five (5) yards or loss of down
3. Clipping: Fifteen (15) yards or loss of down
4. Holding: Fifteen (15) yards or loss of down
5. Personal Foul: Fifteen (15) yards or loss of down
6. Defensive Pass Interference: First down at point of infraction or if the infraction occurs behind the offensive team's side of the line of scrimmage, fifteen (15) yards from the original line of scrimmage plus a first down.
7. Offensive Pass Interference: Ten (10) yards or loss of down
8. Roughing the Kicker: Fifteen (15) yards, plus automatic first down (no option)
9. Illegal Motion: Five (5) yards or loss of down In accordance with the invention herein, one can play said game using a prescribed playing time as determining the completion of same, or in the alternative, by deciding upon a specific number of plays that in fact can be used.

In addition to the above, it is within the scope of this invention to permit the players of a game to utilize, as a variance thereon, the possibility that all of the player pieces do not have to be moved on each roll of a "progression series", but rather, as for example, on the first roll of an offensive "progression series", movement of perhaps six offensive player pieces and on all subsequent progression rolls only four of said player pieces. In a like manner, the defensive player would also be so limited as to said number of player pieces that could be moved on any particular progression roll. In this manner, one achieves modification of the implementation of the present invention without deviating from its inherent concepts and provides an alternative embodiment.

The preceding description and accompanying drawings relate primarily to one specific embodiment of the invention, and the invention in its broader aspects should not be so limited to one specific embodiment as herein shown and described but the departures may be made therefrom within the scope of the accompanying claims without departing from the principles of the invention and without sacrificing its chief advantages.

I claim:

1. The process of playing a game device capable of simulating in all of its aspects in game form upon a game board marked off to simulate a football field and divided into squares so as to designate numerous specific locations on said game board, the game of football, wherein a first player and a second player, each with their own player pieces which are positioned upon said game board in opposing alignments comparable to the various alignments that occur during an actual football game, seek to score points against each other as done in the game of football by the rolling of dice, said process comprising:

(a) the rolling by said first player of a first die so as to determine in a random fashion the movement of said first player's individual player pieces upon said game board any number of squares upon said game board up to the number appearing on the roll of said first die, said movement of said player pieces being compatible with said first player offensively moving his player pieces in accordance with the game of football, (b) the then rolling by said second player of one die so as to determine in a random fashion the movement of said second player's individual player pieces upon said game board any number of squares upon said game board up to the number appearing on the roll of said first die said movement of said player pieces being compatible with said second player defensively moving his player pieces in response to the movement of the player pieces of said first player and in accordance with the game of football;

(c) the then rolling by said first player of two dice so as to determine in a random fashion the movement of said first player's individual player pieces upon said game board any number of squares upon said game board up to the number appearing on the roll of said two dice, said movement of said player pieces being compatible with said first player offensively moving his player pieces in accordance with the game of football;

(d) the then rolling by said second player of two dice so as to determine in a random fashion the movement of said second player's individual player pieces upon said game board any number of squares upon said game board up to the number appearing on the roll of said two dice said movement of said player pieces being compatible with said second player defensively moving his player pieces in response to the movement of the player pieces of said first player and in accordance with the game of football;

(e) the then rolling by said first player of three dice so as to determine in a random fashion the movement of said first player's individual player pieces upon said game board any number of squares upon said game board up to the number appearing on the roll of said three dice, said movement of said player pieces being compatible with said first player offensively moving his player pieces in accordance with the game of football;

(f) the then rolling by said second player three dice so as to determine in a random fashion the movement of said second player's individual player pieces upon said game board any number of squares upon said game board up to the number appearing on the roll of said three dice said movement of said player pieces being compatible with said second player defensively moving his player pieces in response to the movement of the player pieces of said first player and in accordance with the game of football;

(g) the then rolling by said first player of four dice so as to determine in a random fashion the movement of said first player's individual player pieces upon said game board any number of squares upon said game board up to the number appearing on the roll of said four dice, said movement of said player pieces being compatible with said first player offensively moving his player pieces in accordance with the game of football;

(h) the then rolling by said second player of four dice so as to determine in a random fashion the movement of said second player's individual player pieces upon said game board any number of squares upon said game board up to the number appearing on the roll of said four dice said movement of said player pieces being compatible with said second player defensively moving his player pieces in response to the movement of the player pieces of said first player and in accordance with the game of football;

(i) continuing said rolls until a defensive player piece either crosses a square on said game board simultaneously with the offensive player piece designated to be carrying the ball or the player designated to be carrying the ball has crossed his opponent's goal line.

* * * * *